US009630298B2

(12) United States Patent
Okulov

(10) Patent No.: US 9,630,298 B2
(45) Date of Patent: Apr. 25, 2017

(54) ROTARY ABRASIVE BRUSH FOR DEBURRING AND METHOD OF MANUFACTURING

(75) Inventor: Paul D. Okulov, Ste-Anne-de-Bellevue (CA)

(73) Assignee: Deburr Technologies, Montreal (CA)

( * ) Notice: Subject to any disclaimer, the term of this patent is extended or adjusted under 35 U.S.C. 154(b) by 459 days.

(21) Appl. No.: 14/235,558

(22) PCT Filed: Jul. 31, 2012

(86) PCT No.: PCT/CA2012/000719

§ 371 (c)(1),
(2), (4) Date: Mar. 28, 2014

(87) PCT Pub. No.: WO2013/016806

PCT Pub. Date: Feb. 7, 2013

(65) Prior Publication Data

US 2014/0242892 A1 Aug. 28, 2014

Related U.S. Application Data

(60) Provisional application No. 61/513,630, filed on Jul. 31, 2011.

(51) Int. Cl.
*B24D 9/04* (2006.01)
*B24D 13/04* (2006.01)
(Continued)

(52) U.S. Cl.
CPC ..... *B24D 9/04* (2013.01); *B24D 9/00* (2013.01); *B24D 9/003* (2013.01); *B24D 13/04* (2013.01);
(Continued)

(58) Field of Classification Search
CPC . B24D 9/00; B24D 9/003; B24D 9/04; B24D 13/00; B24D 13/04; B24D 13/10;
(Continued)

(56) References Cited

U.S. PATENT DOCUMENTS 2,879,631 A * 3/1959 Peterson ..... A46D 1/00 15/104.2
5,404,681 A * 4/1995 Scheider ..... B24D 13/04 451/466
(Continued)

FOREIGN PATENT DOCUMENTS

DK 171364 B1 9/1996
GB 2150470 A 7/1985
(Continued)

*Primary Examiner* — Eileen Morgan
(74) *Attorney, Agent, or Firm* — Muncy, Geissler, Olds & Lowe, P.C.

(57) ABSTRACT

A rotary tool containing a core hub with helical groove on its outer surface filled in with continuous abrasive filament formed by folding of a pre-cut abrasive sheet including multiple bristle like straps extending radially from the hub. The method of manufacturing includes the steps of providing a hub, and forming a helical groove with inverted V-shaped cross-section along its cylindrical surface. An abrasive element is wound around the hub so that the folded edge is fed in the V-grove and is buckled inside the groove providing, along with securing it by sufficient pre-tension of the abrasive element, a secure anchoring of the abrasive element through locking of the buckled edge. The abrasive filament is formed from a roll of abrasive cloth as one continuous piece using a cutting operation and is provided with center-line perforations. These perforations assist folding the filament by providing it with discrete and desired flexibility as well as weakening it in such way that it assists the process of folded edge buckling inside the groove during
(Continued)

winding and therefore forms a tight anchoring junction with the hub without need for an adhesive.

19 Claims, 4 Drawing Sheets

(51) Int. Cl.
*B24D 9/00* (2006.01)
*B24D 13/16* (2006.01)
*B24D 18/00* (2006.01)

(52) U.S. Cl.
CPC ..... *B24D 13/16* (2013.01); *B24D 18/0036* (2013.01); *Y10T 29/49826* (2015.01)

(58) Field of Classification Search
CPC .. B24D 13/16; B24D 18/009; B24D 18/0036; Y10T 29/49826
USPC ..... 451/466, 496
See application file for complete search history.

(56) References Cited

U.S. PATENT DOCUMENTS

| | | | | |
|---|---|---|---|---|
| 5,496,385 | A * | 3/1996 | Scheider | B24D 13/04 51/293 |
| 5,922,160 | A * | 7/1999 | Audisio | B24D 13/04 156/257 |
| 2012/0064811 | A1* | 3/2012 | Jespersen | B24D 13/06 451/540 |
| 2016/0008946 | A1* | 1/2016 | Okulov | B24B 27/033 451/56 |

FOREIGN PATENT DOCUMENTS

| | | | |
|---|---|---|---|
| GB | 2169227 | A | 7/1986 |
| JP | 62-114881 | A | 5/1987 |
| WO | WO97/18060 | A1 | 5/1997 |

* cited by examiner

FIG. 9
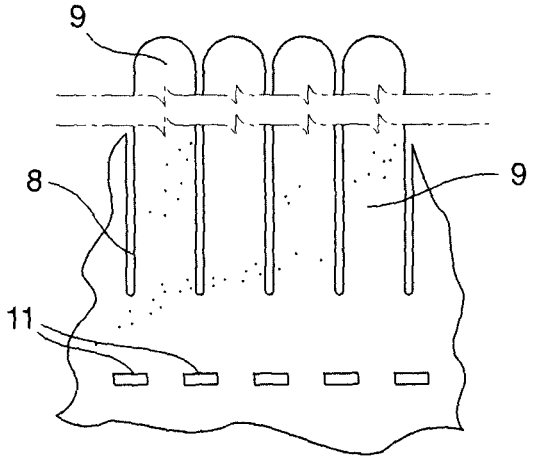
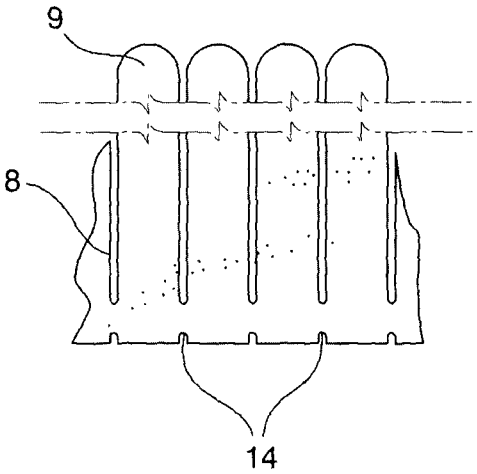
FIG. 10
FIG. 11
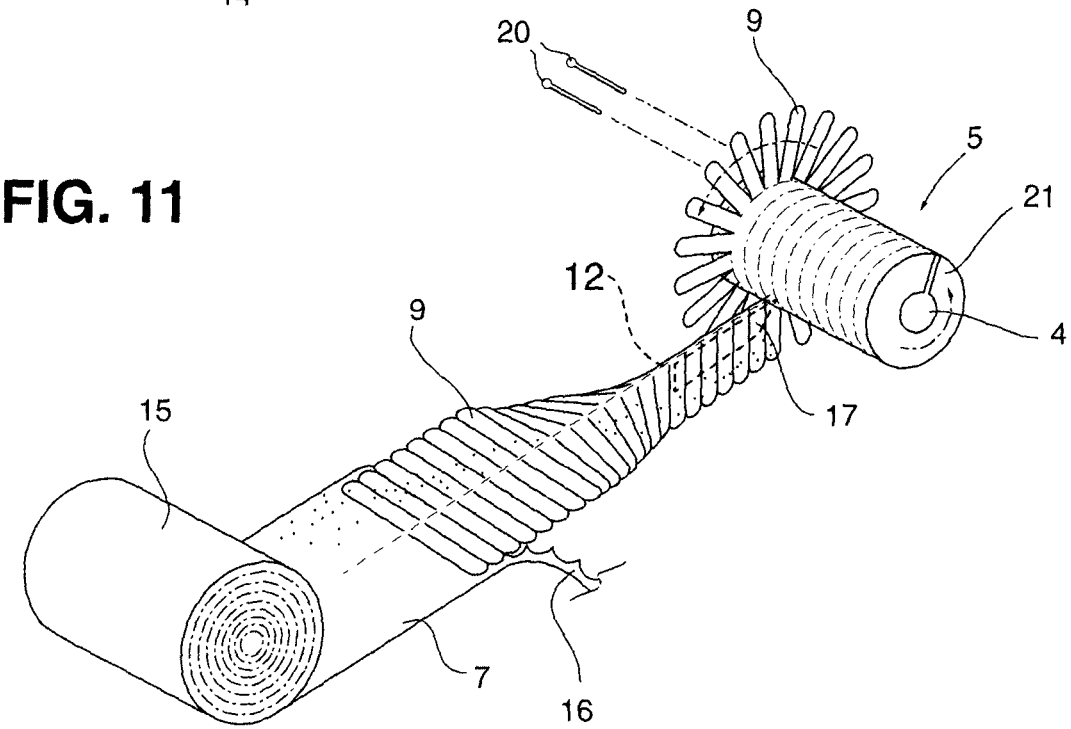

ROTARY ABRASIVE BRUSH FOR DEBURRING AND METHOD OF MANUFACTURING

FIELD OF THE INVENTION

The invention relates generally to abrasive finishing and deburring tools and methods of making such tools.

BACKGROUND ART

Abrasive tools utilizing flapping tapes or straps extending radially from the hub are well known in the prior art. One such device known as "Fladder" uses rotating tools composed of layers of ring-shaped abrasive wheels which is the subject matter of U.S. Pat. No. 4,518,452, issued to Hundelbol with abrasive straps extending outwards radially and forming a cylindrical brush-like tool. A plurality of such rotary tools can be used simultaneously as discussed in U.S. Pat. No. 6,015,334, to achieve the highest efficiency and uniformity of material removal and at the same time provide for a simple method of accessing of all types of pockets, holes, edges and structural parts. This type of a tool is specifically desired in aerospace manufacturing processes and is extremely efficient.

There are a variety of abrasive brushes with bristle like abrasive extremities. For instance in United States publication No. 2008/0189923, assigned to 3M, an abrasive filament includes abrasive particles imbedded into a polymeric matrix which can be moulded. The United States application uses wires and rollers to hammer the surface and provide cleaning by impact.

U.S. Pat. No. 5,903,951, assigned to Minnesota Mining and Manufacturing Company provides moulded bristles.

U.S. Pat. Nos. 5,643,068 and 5,197,998 assigned to Minnesota Mining and Manufacturing Company and U.S. Pat. No. 5,125,192 assigned to Dynabrade, Inc., generally teach tools where abrasive filaments are provided as a stack of flat abrasive sheets of variety of shapes with slits separating it into strap like members.

In U.S. Pat. No. 5,423,718 assigned to Jason, Inc., grooves are provided in the direction of the length of an abrasive tool drum for insertion and anchoring of the folded abrasive sheets. Another example of a slotted support drum structure is described in U.S. Pat. No. 5,083,840, also assigned to Minnesota Mining and Manufacturing Company.

A variety of prior art references are related to utilization of helical patterns of winding of brush filaments around the drum, namely U.S. Pat. Nos. 3,688,335 by Clark and 2,782,439 by Ballard. The method for preparation of flattened brush filament and its winding is described in U.S. Pat. No. 2,294,480 by Rohweder et al.; an abrasive wheel with helical outer surface is described in U.S. Pat. No. 2,115,209 by Mulholland et al. U.S. Pat. No. 6,390,708 assigned to L'Oreal teaches a variety of helical grooves provided for fixation of brush bristles assemblies.

Folded abrasive filaments made from flat sheets and arranged into abrasive disks are described in U.S. Pat. No. 3,727,353, assigned to the United Aircraft Corporation.

One of the more common abrasive finishing wheels known from the prior art is a flap wheel. Typically, flap wheels are formed by a radial array of sheets of paper or rayon cloth with a layer of abrasive grit such as aluminium oxide resin bonded to one side. Such tools are useful for contoured polishing, cutting and blending of ferrous and non-ferrous metals, plastic and wood. However, such tools can only be run in one direction. The layer of adherent abrasive to one side of the cloth tends to wear the cloth or paper of the adjacent flap.

Limitations of such tools in the art remain due to their high cost, resulting from labour intensive manufacturing processes.

Turning now to methods of continuous manufacturing of such tools, U.S. Pat. No. 2,879,631, by Peterson teaches a brush and method of manufacturing, including steps of slitting the precursor sheet or tape of abrasive for providing abrasive straps, folding the precursor and mounting it on a support element by using the openings cut in the precursor close to the folding line, where the support element is then wound around the tool drum. Although useful, this method has operations of mounting the folded abrasive on additional support element, which are difficult to automate.

In U.S. Pat. No. 2,783,095, by Ballard, a method of forming a helical groove using rubber strap wound around brush drum is taught.

Finally, methods of describing abrasive sheets stacking or winding operations assisting cost reduction are presented in U.S. Pat. Nos. 2,626,414 and 5,922,160.

The prior art lacks instruction regarding an arrangement where a folded filament is wound around a drum in a helical pattern to provide an anchoring effect by buckling inside a supporting groove.

The present invention satisfies this need.

DESCRIPTION OF THE INVENTION

One object of the present invention is to provide an inexpensive abrasive brush suitable for deburring or finishing operations in aerospace manufacturing.

It is a further objective to provide a method of manufacturing of such brushes, in a continuous manner, which is economic with respect to waste, low labour input and accommodating from a production point of view to allow a variety of brush shapes useable in numerous machines and equipment presently available on the market.

According to one embodiment, a brush drum is provided, made from a polymeric foam by a cutting operation said as hot wire or hot knife cutting. The foam has a helical groove on its outer surface with inverted V-shape in cross section. An abrasive filament is prepared from a precursor abrasive tape or sheet(s) (rejoined, if needed to form a continuous tape) by cutting a pattern having extremities or straps integrally formed from the precursor. These patterns can be cut by laser, progressive die or by any other suitable methods, including, but not limited to: water jet cutting, slicing, etc. The pattern may have a mirrored shape or can be single. In the case of the mirrored shape, the pattern is folded and fed as a continuous piece into the groove by its folded edge. Perforations provided along the center line make folding easy and also determine the way the edge will buckle inside the V-shaped groove providing to filament anchoring inside the groove without the need for an adhesive, thus significantly simplifying manufacturing process and reducing the overall cost.

For a single pattern (non-folded), notches or perforations may be provided near the continuous edge for assisting buckling inside the groove.

The inverted V-shape groove is not limited to an exact V-shape, but rather provides freedom for the edge of the filament to buckle inside the groove, restricting its width after buckling to achieve a desired frictional junction between the abrasive and the material of the drum. It is desirable that abrasive precursor be folded in such way that the abrasive particles are facing the drum material inside the groove, thus providing good traction.

It is important to note that the groove can be either integral with the drum or formed by a variety of methods, including winding over the drum, an additional piece forming the helical gap, injection moulding, spraying, 3D printing, etc.

The groove may be formed during the drum manufacturing process, for instance moulding, or, in another embodiment formed afterwards by cutting with a hot knife of a desired profile. Using a hot tool for forming the groove in foamed polymers aids in partially closing the pores and increases the strength of the walls of the groove.

Securement of the ends of the filament in the helical groove may be simply achieved by pins inserted in the drum material through the ends of the filament, generally perpendicular to the surface of the filament and groove containing it.

The shape of the perforation (or notches in case of a single, non-folded filament) defines the pattern of buckling on the edge of the filament inside the groove and can vary with design. A thin knife-like tool can be used to assist insertion of the filament into the helical groove with the tool being aligned and slideably positioned inside its folded line next to the filament entering point. It is desired that the leading edge of the tool be tangential to the inner radius of the groove and its tip does not extend into the area of edge buckling, immediately realised upon onset of winding. The filament edge bends to follow the radius of the groove.

The width of buckling "Δ" (theoretically, the dimension through the middle of the abrasive sheet) is defined by two radii R1 and R2 of the helical groove and the pitch of buckling (defined by the width of the extremities "a") or the pitch of the perforations, if not the same with width "a". Generally, Δ can be determined from the following formula:

$$\Delta = a*SQRT(1-(R1/R2)\hat{}2).$$

For instance, if a=6 mm, R1=54 mm, R2=60 mm then Δ=2.6 mm. Thus, accounting for the added thickness of the filament equal to t=0.5 mm (example only) and in order to provide good anchoring of the filament, the maximum width of the V-shaped groove should be less than 3.1 mm.

In order to assist buckling and make the shape of buckled edge persistent and repetitive, an additional pre-bending operation may be employed as well as specialized shapes of the perforation or other designed cuts made in the precursor.

As an additional means, a cord can be passed along the folded edge of the filament to add strength to the filament, especially for high rotational speeds causing centrifugal force and thus high forces on filament extremities. Alternatively, adhesive or glue and reinforcing cord can be used for highly durable products in demanding applications.

The abrasive brush of present invention can be either disposable or reusable since the drum and groove do not wear during tool operation and a new filament can be used to refurbish the brush. The brush can be manufactured at a fraction of the cost present systems like the Fladder (supra) offers and therefore can encourage use of this simple yet effective deburring method and increase its to acceptance within the aerospace industry reducing the overall costs of production of aluminium and titanium parts. It can also promote its use in deburring and finishing operations in general metal working and wood/plastic working industries.

BRIEF DESCRIPTION OF THE DRAWINGS

FIG. 9 provides greater details of the perforation assuring folding of the filament precursor and buckling of its edge;

FIG. 10 is another variant of filament made from a non-folded abrasive precursor and having notches at the edge to be inserted and buckled inside the groove, and FIG. 11 illustrates the continuous process of manufacturing of the abrasive brush.

BEST MODE FOR CARRYING OUT THE INVENTION

Figure 1:
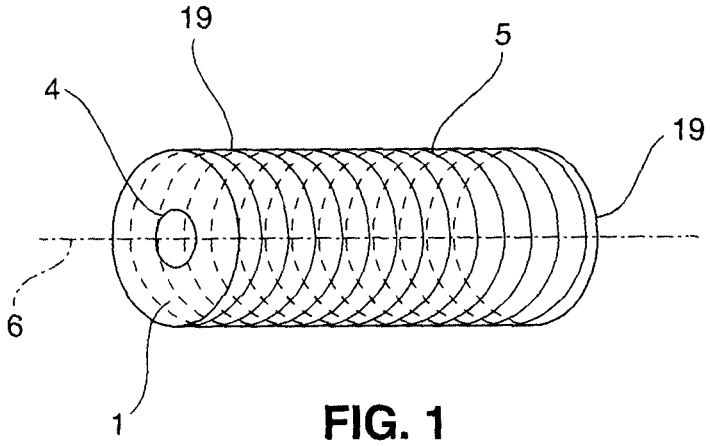
FIG. 1 is a general view of the hub (core) of the rotary brush made in a shape of a cylinder with a helical groove.
Figure 2:
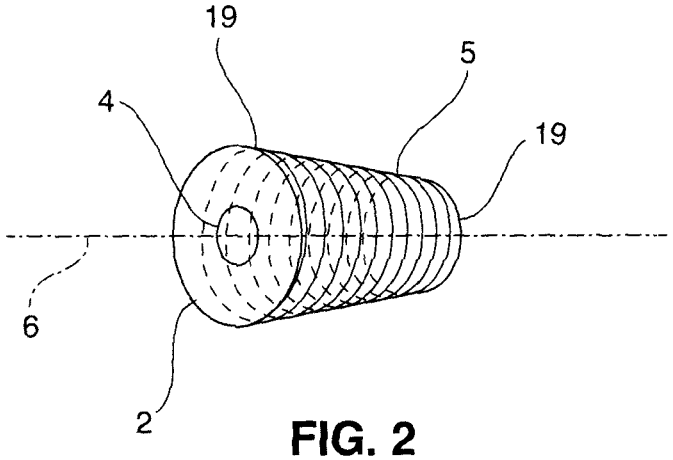
FIG. 2 is a general view of the hub (core) of the rotary brush made in a shape of a cone with a helical groove.
Figure 3:
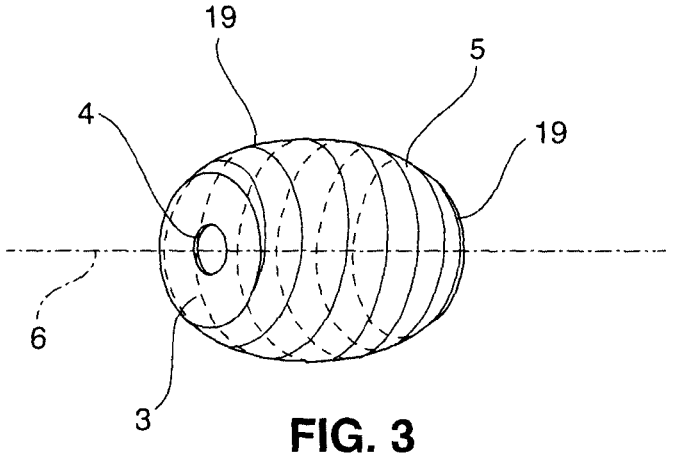
FIG. 3 is a general view of the hub (core) of the rotary brush made in a shape of a barrel with a helical groove.

Referring initially to FIGS. 1 through 3, there is illustrated a variety of shapes for the brush cores 4, namely: cylindrical (FIG. 1), conical (FIG. 2) or barrel type (FIG. 3) with helical grooves 5 made on outer surfaces and bores 4 aligned with central rotational axes 6.

End zones 19 of the grooves are used for anchoring the ends of the filament, generally denoted as plurality of extremities 9 with end radii 10 made by cutting abrasive tape 7 (FIG. 4) with slits 8, further described in the following figures.

Figures 4, 5:
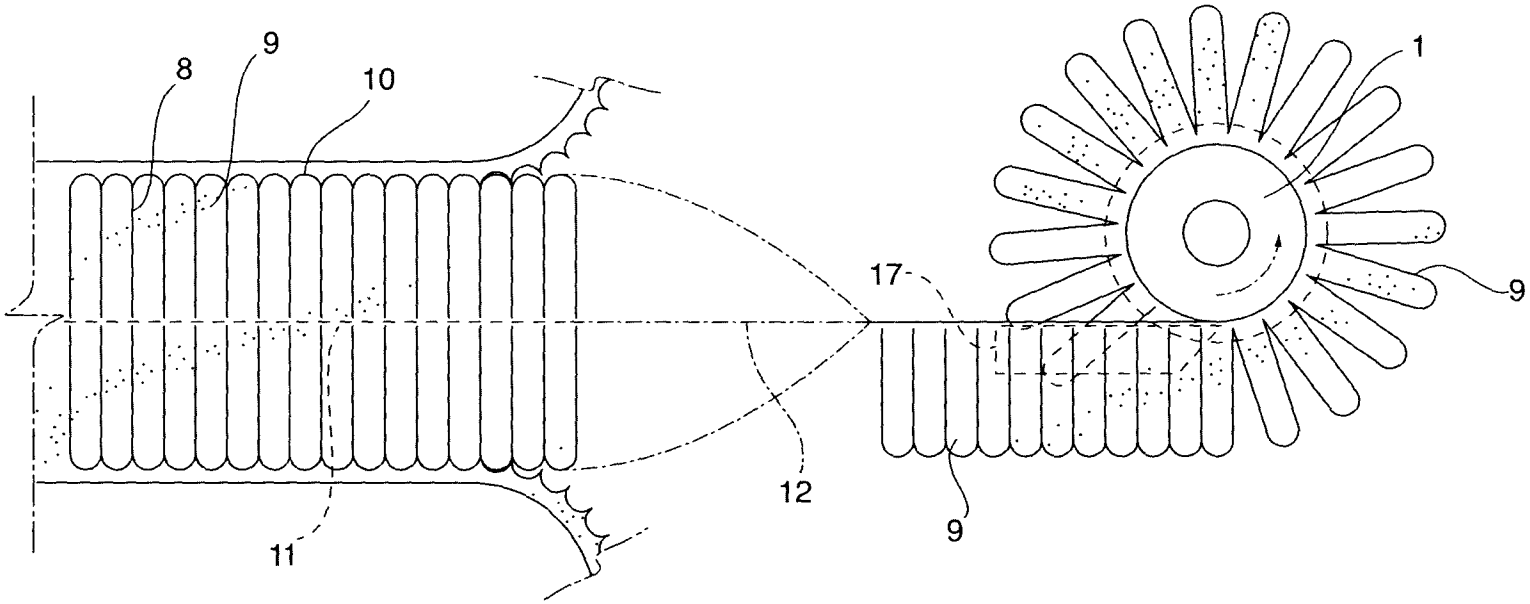
FIG. 4 shows one variant of the symmetrical foldable pattern of the precursor of the abrasive filament cut from a tape.
FIG. 5 illustrates the process of winding of the folded filament around the drum.

FIG. 5 schematically illustrates the general process of winding the filament 9 over drum 1 with the assistance of a feeding knife 17 aligned within fold line 12 (FIG. 4) of filament 9.

Figure 6:
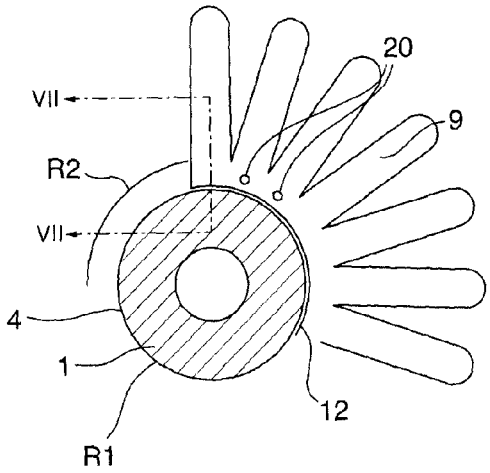
FIG. 6 is a cross-section of the drum with anchoring pins for the ends of the filament and with central bore for securing on the spindle.

Referring now to FIG. 6, pins 20, also presented in FIG. 11, are shown after insertion in drum 1 through the end part of filament 9 and generally perpendicular to its plane.

Figure 7:
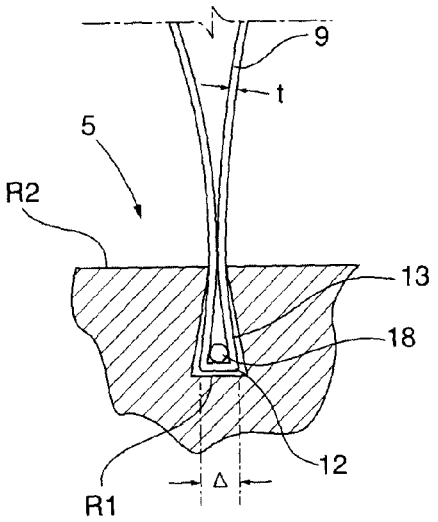
FIG. 7 is cross-section along line 7-7 of FIG. 6 of the spiral groove with folded filament in it and illustrating anchoring effect of the buckled edge of the folded line of the filament due to frictional/clamping forces.
Figure 8:
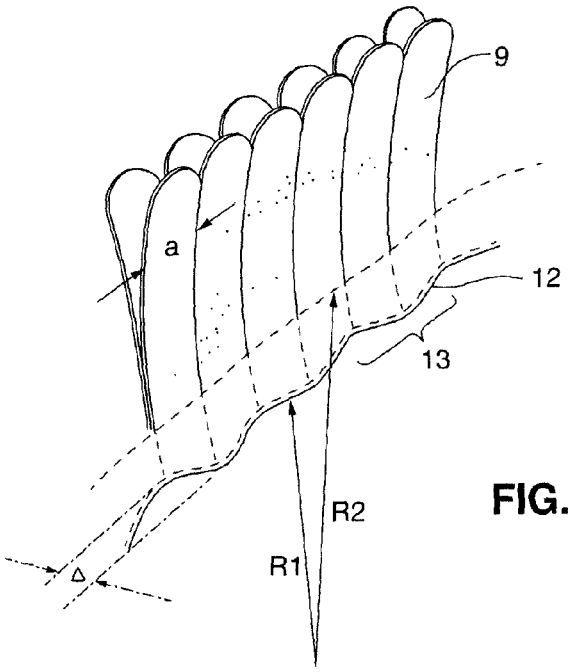
FIG. 8 illustrates in greater detail effect of buckling of the filament's folded edge.

FIG. 7 illustrates a cross-section of an inverted V-shape groove per FIG. 6 where folded edge 12 is buckled into a shape 13 also shown in greater detail in FIG. 8. Alternatively, a cord 18 can be used to reinforce the position of the filament 9 inside the groove 5.

The theoretical width of buckled edge 12 is denoted by "Δ", which, as to mentioned above, is related to the ratio between radii R1 and R2 winding of filament 9 around drum 1. In essence, the depth of the groove 5 relative to the diameter of drum 1 and to the width "a" of the filament extremities 9 along with the width of the groove, define the end rate of buckling and level of clamping.

Perforations 11 (FIGS. 8 and 9) or notches 14 (FIG. 10) provide intentional weakening of the filament edge 12 and assist in provoking the automatic buckling of the edge 12 inside the groove. These perforations can also be used in feeding and indexing during laser cut or other cutting processes.

The manufacturing process (FIG. 11) can be continuous and includes feeding the abrasive tape 7 from a precursor roll 15, cutting or slicing to achieve desired pattern of filament(s) 9, removal of unused parts 16 of tape 7, folding along line 12 aligned with perforations 11, feeding into the groove 5 using knife 17 or other means and fixing the ends of filament 9 by pins 20 or other anchoring or securement means.

One method of making drum 1 from foam material (example of which may be Polystyrene or Styrofoam® of 2-6 lbs/ft^3 of density) is by using a hot wire. Slot 21, shown in FIG. 11 can be used for assisting such cutting and also can be used to secure drum 1 on the axle (not shown) necessary for winding and provide spring like effect to the drum 1 to equalize tension of the filament after winding. The final dimension of bore 4 can be assured by an additional finishing operations with conventional or specialized tools applicable for bore finishing in polymeric foams.

Another desired method for making the inverted V-shape groove from the same material is by using a hot knife of an appropriate shape while the drum precursor is rotating with an axial feed rate generally equal to the pith of the helical groove. As mentioned above, all the operations can be done simultaneously or sequentially.

Similar to the abrasive flap wheels known from the prior art, the tools of FIGS. 1 through 11 may be driven for rotation in either direction and since the abrasive material always has a higher coefficient of friction with the surface to be finished compared to the backing material, the filaments 9 are twisted and automatically face the working surface, providing high efficiency abrading and self-cleaning.

What is claimed is:

1. An abrasive tool, comprising:

a rotatable body having an outer surface and a helical groove formed within said outer surface, said helical groove having a bottom and an opening, said helical groove having an inverted v-shaped cross sectional profile wherein said bottom of said helical groove is wider than said opening of said helical groove;

a continuous abrasive filament having a first end, a second end, a longitudinally oriented fold center line and a plurality of abrasive straps integral with said filament and extending outwardly from said fold center line of said filament, each of said plurality of abrasive straps defined from an adjacent one of said plurality of abrasive straps by at least a first slit extending outwardly from said fold center line of said filament, each said first slit having an end outwardly and laterally removed from said fold center line, said filament being positioned within said helical groove by a longitudinally oriented folded edge, said filament having a plurality of longitudinally extended perforations oriented longitudinally along said fold center line of said filament at a position on the fold center line which is separated from and corresponds to said first slit, and is adapted to assist folding of said filament along said fold center line thereby providing said longitudinally oriented folding edge along said fold center line, said plurality of perforations assisting buckling of said longitudinally oriented folding edge as said filament is wound over said rotatable body, the first end and the second end of said filament being secured with respect to said rotatable body.

2. The rotary tool as set forth in claim 1, wherein said body is composed of foam.

3. The rotary tool as set forth in claim 2, wherein said foam is polymeric foam.

4. The rotary tool as set forth in claim 3, wherein said foam is polystyrene.

5. The rotary tool as set forth in claim 1, wherein said abrasive filament comprises abrasive tape.

6. The rotary tool as set forth in claim 5, wherein said abrasive tape comprises cloth backed abrasive tape.

7. The rotary tool as set forth in claim 1, including separations between said straps provided in a shape assisting augmenting strength and reducing wear and tearing of said straps.

8. The rotary tool as set forth in claim 1, wherein said body comprises a hub.

9. The rotary tool as set forth in claim 8, wherein said hub is barrel shaped.

10. The rotary tool as set forth in claim 8, wherein said hub is cylindrical.

11. The rotary tool as set forth in claim 8, wherein said hub is conical.

12. The rotary tool as set forth in claim 1, wherein the perforations has a length and a width, the length extends in the longitudinal direction, and the length is greater than the width.

13. A method of manufacturing an abrasive tool, comprising:

a) providing a rotatable body having an outer surface;

b) providing a helical groove within said outer surface of said rotatable body, said helical groove having a bottom and an opening, said helical groove having a bottom and an opening, said helical groove having an inverted v-shaped cross sectional profile wherein said bottom of said helical groove is wider than said opening of said helical groove;

c) providing a flexible length of abrasive material having a first end, a second end, a longitudinally oriented fold center line and a plurality of abrasive straps integral with said filament and extending outwardly from said fold center line of said filament, each of said plurality of abrasive straps defined from an adjacent one of said plurality of abrasive straps by at least a first slit extending outwardly from said fold center line of said filament, each said first slit having an end outwardly and laterally removed from said fold center line, said filament being positioned within said helical groove by a longitudinally oriented folded edge, said filament having a plurality of longitudinally extended perforations oriented longitudinally along said fold center line of said filament at a position on the fold center line which is separated from and corresponds to said first slit, and is adapted to assist folding of said filament along said fold center line thereby providing said longitudinally oriented folding edge along said fold center line, said plurality of perforations assisting buckling of said longitudinally oriented folding edge as said filament is wound over said rotatable body, the first end and the second end of said filament being secured with respect to said rotatable body;

d) folding said flexible length of abrasive material centrally between said strap members along said fold center line;

e) positioning said longitudinally oriented folding edge of said flexible length of abrasive material within said helical groove; and f) securing said longitudinally oriented folding edge of said flexible length of abrasive material within said helical groove on said body.

14. The method as set forth in claim 13, wherein said flexible length is produced by laser cutting or die cutting or water jet cutting of said abrasive material.

15. The method as set forth in claim 13, wherein said groove in said body is formed by cutting said body with a hot tool.

16. The method as set forth in claim 13, wherein said flexible length comprises tape.

17. The method as set forth in claim 16, wherein said tape comprises cloth backed tape.

18. The method as set forth in claim 13, wherein steps a) through e) are continuous.

19. The method as set forth in claim 13, wherein
the perforations has a length and a width,
the length extends in the longitudinal direction, and
the length is greater than the width.

* * * * *